US005512006A

United States Patent [19]

Wood et al.

[11] Patent Number: 5,512,006

[45] Date of Patent: Apr. 30, 1996

[54] METHOD FOR ENHANCING THE RUST RESISTANCE AND THE SURFACE FINISH OF A NON-FERROUS WORKPIECE

[75] Inventors: W. Gary Wood, Bloomfield Hills; Gary J. Stevers, Livonia, both of Mich.

[73] Assignee: Ultra Blast Partners, Canton, Mich.

[21] Appl. No.: 144,690

[22] Filed: Oct. 29, 1993

[51] Int. Cl.[6] ..... B24C 11/00

[52] U.S. Cl. ..... 451/39; 451/38; 72/53

[58] Field of Search ..... 451/38, 39, 40; 72/53

[56] References Cited

U.S. PATENT DOCUMENTS

| | | | |
|---|---|---|---|
| 2,059,915 | 11/1936 | Ruch | 51/309 |
| 3,188,776 | 6/1965 | Dill | 451/39 |
| 3,249,423 | 5/1966 | Stewart . | |
| 3,270,398 | 9/1966 | Stewart . | |
| 3,271,992 | 9/1966 | Stewart . | |
| 3,844,846 | 10/1974 | Friske et al. | 148/11.5 R |
| 3,939,613 | 2/1976 | Ayers | 451/39 |
| 4,023,985 | 5/1977 | Dunkerley et al. | 148/3 |
| 4,071,381 | 1/1978 | Dunkerley et al. | 148/36 |
| 4,115,076 | 9/1978 | Hitzrot, Jr. | 451/39 |
| 4,190,422 | 2/1980 | Hitzrot, Jr. | 451/39 |
| 4,424,083 | 1/1984 | Polizzotti et al. | 148/12 E |
| 4,449,331 | 5/1984 | MacMillan | 51/425 |
| 4,907,379 | 3/1990 | MacMillan | 51/426 |

OTHER PUBLICATIONS

SAE Recommended Practice for Cast Steel Shot J827 from Mar. 1990.

*Primary Examiner*—Robert A. Rose
*Attorney, Agent, or Firm*—Young & Basile

[57] ABSTRACT

A method for enhancing the rust resistance and the surface finish of a non-ferrous workpiece, such as aluminum, is disclosed. The method comprises the step of impinging the workpiece surface for a predetermined amount of time with a high velocity stream of ferrous particles. The ferrous particles preferably have a hardness less than approximately 40 Rockwell C, preferably 20-40 Rockwell C, and still more preferably 30-40 Rockwell C. The particles are not tempered before impinging. This substantially eliminates stress cracks in the ferrous particles, thus substantially preventing any particulate ferrous matter from becoming imbedded in the impinged workpiece surface, which imbedded particulate matter may be prone to rust.

36 Claims, 4 Drawing Sheets

METHOD FOR ENHANCING THE RUST RESISTANCE AND THE SURFACE FINISH OF A NON-FERROUS WORKPIECE

BACKGROUND OF THE INVENTION

The present invention relates generally to a method for enhancing the rust resistance and the surface finish of a non-ferrous workpiece, and more particularly to such a method useful in blastcleaning, profiling or shot peening non-ferrous materials, such as aluminum castings, using ferrous shot media.

Aluminum castings and other non-ferrous materials require surface preparation, cleaning, peening or profiling during the manufacturing process. These products are often blasted with conventional steel shot, such as tempered Martensite and/or a blend of Martensite steel shot and grit. The Martensite steel shot or grit fractures during use and deposits small fragments of ferrous materials into the surface of the aluminum or other non-ferrous castings. Further, steel grit generally etches the metal. Unless the casting undergoes some type of chemical or other post-treatment to remove the imbedded materials, this residue later forms rust on the surface of the non-ferrous parts upon exposure to air and moisture. However, there are drawbacks involved in chemical or other post-treatments, in that they are generally expensive, time consuming, require extra manufacturing facilities, and may damage the casting.

Aluminum oxide grit may also be used for aggressive cleaning, however, this etches the metal, leaves behind a residue, and has a relatively short useful life.

The conventional alternatives for blasting non-ferrous materials without leaving behind residue generally include the use of glass beads, sand, stainless steel shot, plastic chips, ceramic shot, salt, walnut shells, or the like. With the exception of stainless steel shot, for the other materials to be useful, the part must be exposed to the materials by blasting for excessive amounts of time; and the materials themselves generally have a relatively short useful life. As a result, these materials are generally too costly and are not feasible for a high production manufacturing facility. Stainless steel shot may be used in a conventional centrifugal wheel type blast machine, but the cost of the shot, as much as $7 per pound, is quite high as compared to Martensite shot or steel grit, either of which range between $.20 to $.30 per pound. Aluminum shot also may be used on aluminum, but this has a relatively short useful life, and is also quite expensive, as much as $3 per pound. As such, the cost of stainless steel or aluminum shot becomes prohibitive in most cases.

Thus, it is an object of the present invention to provide a method for enhancing the rust resistance and the surface finish of a non-ferrous workpiece, such as aluminum, brass or titanium alloy workpieces, using ferrous shot media or particles. It is a further object of the present invention to provide such shot media or particles which advantageously is available in great quantity and at low cost. Further, it is an object of the present invention to provide such shot media which does not fracture, thereby substantially avoiding imbedded particles, which may be prone to rust, in the workpieces. This may further advantageously eliminate any need for chemical or other post-treatment to remove rust-prone particulate matter. Still further, it is an object of the present invention to provide such shot media having a reduced hardness, without need for tempering, which may advantageously provide an enhanced surface finish as compared to conventional shot media. Yet still further, it is an object of the present invention to provide such shot media having a reduced hardness such that the blastcleaning, peening, or other machinery used may advantageously be comprised of less expensive, low grade steel wear parts.

SUMMARY OF THE INVENTION

The present invention addresses and solves the problems enumerated above. The present invention comprises a method for economically enhancing the rust resistance and the surface finish of a non-ferrous workpiece, such as aluminum. The method comprises the step of impinging the workpiece surface for a predetermined amount of time with a high velocity stream of ferrous particles, such as ferrous shot media. The ferrous particles have a hardness less than approximately 40 Rockwell C, preferably 20–40 Rockwell C, and still more preferably 30–40 Rockwell C. The particles are not tempered before use. This substantially eliminates stress cracks in the ferrous particles, which helps to prevent fracturing of the ferrous particles, thus substantially preventing any particulate ferrous matter from becoming imbedded in the impinged workpiece surface, which imbedded particulate matter may be prone to rust.

The file of this patent contains at least one color photograph. Copies of this patent with color photograph(s) will be provided by the Patent and Trademark Office upon request and payment of the necessary fee.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
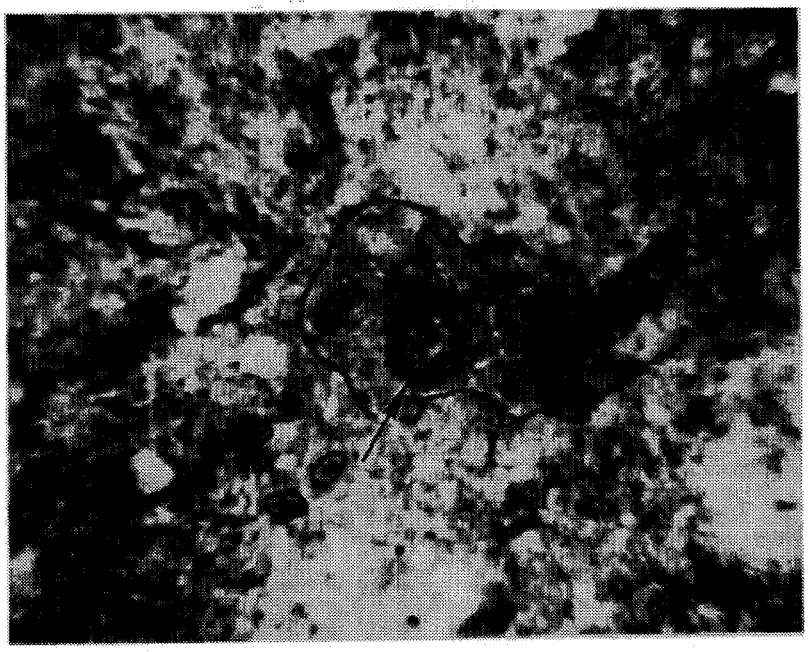
FIG. 1 is a close up at 25× power of an aluminum casting that has been blastcleaned with a blend of martensite shot and grit in a conventional centrifugal wheel type airless blasting machine, showing a ferrous particle imbedded in the aluminum casting during the blastcleaning process.

The present invention comprises a method for enhancing the rust resistance and the surface finish of a non-ferrous workpiece having a surface. The non-ferrous workpiece as contemplated may be formed from any non-ferrous material, including, but not limited to aluminum, titanium alloys, nickel-cobalt alloys, aluminum alloys, and brass. Similarly, various workpieces contemplated include, but are not limited to engine cylinder heads, exhaust manifolds, air intake manifolds, blades and disks for aircraft turbines and compressors, structural aircraft parts and landing gear, jet engine impellers and other general aircraft parts, gas turbine parts, jet engine blades, pump shafts and impellers, valves and water meters.

The method comprises the step of impinging the workpiece surface for a predetermined amount of time with a high velocity stream of ferrous particles, the ferrous particles having a hardness less than approximately 40 Rockwell C. It is to be understood that, as used in the present specification, "ferrous" is to be understood as meaning: of, containing or derived from iron. Further, it is to be understood that the impinging of the workpiece surface may take place during any of a variety of applications. However, preferably, the impinging will be carried out during at least one of a blast cleaning, profiling, peening, and surface preparation process.

When used in conjunction with a blastcleaning process, any conventional blasting machines may be used, such as a conventional centrifugal wheel type airless blasting machine. An example of a conventional blasting machine is a twelve foot table blast WHEELABRATOR blast machine. In such a machine, the amount of blasting time is generally determined by the type, surface, size and shape of the workpiece to be blasted. As an illustrative example, a typical aluminum exhaust manifold may be blastcleaned between about one and three minutes.

In a similar manner, the velocity of the particle stream is generally determined by the type, size and mass of the particles. As a further illustrative example, a typical aluminum exhaust manifold blastcleaned by ferrous particles of the present invention may be impinged with a stream of ferrous particles having a velocity ranging between about 200 and about 300 feet per second.

If the method is used in conjunction with a shot peening process, any conventional peening equipment may be used, such as: an airless centrifugal wheel peening machine; a pneumatic peening machine using either suction induction, gravity induction or direct pressure; or a slurry peening machine.

Similarly, with the remaining processes and applications, including those listed above and those not specifically listed, the present inventive method and ferrous particles are useful within the generally used machinery.

The present inventive method is predicated upon the unexpected discovery that use of the ferrous particles of the present invention substantially reduces the risk of rust on non-ferrous workpieces. Without being bound to any theory, it is believed that this is due to the fact that, by lowering the carbon content and consequently the hardness of carbon cast steel shot, such that the shot, as cast, has a hardness below about 40 Rockwell C, the shot may substantially resist fracturing during use. As such, the risk of fractured particulate ferrous matter becoming imbedded into a non-ferrous workpiece, such as aluminum, is substantially avoided. This is desirable due to the fact that such imbedded particles may be prone to rust the workpiece upon exposure to air and moisture.

Referring now to FIG. 1, such an imbedded particle is depicted by the arrow. The resultant rust areas are shown within the black circles. With traditional high carbon cast steel shot, the shot as cast has a hardness exceeding the SAE required range of 40–50 Rockwell C, as specified in SAE Recommended Practice J827.

Figure 3A:
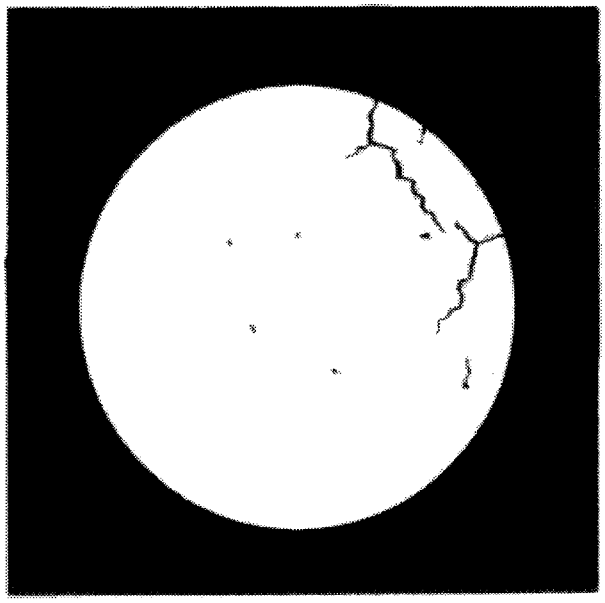
FIG. 3A is a representation of a close up at 50× power of virgin conventional martensite shot, showing the stress cracks induced during the production and tempering processes by which the martensite shot is made.

The generally used high carbon cast steel shot is known as Martensite. In order to bring the Martensite to the specified hardness range, it must be tempered. However, during tempering, stress cracks are introduced into the Martensite shot, which cracks are one of the contributing factors to the fracturing and subsequent undesirable particulate imbedding upon use of the shot. Some illustrative stress cracks are shown in FIG. 3A, which shows martensite shot before use.

Figure 3B:
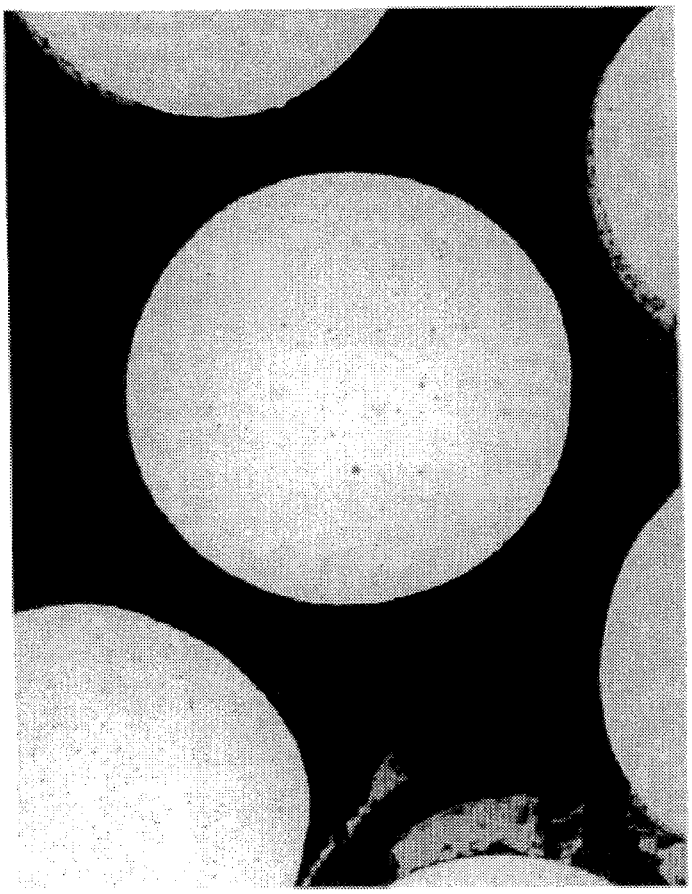
FIG. 3B is a close up at 100× power of virgin ferrous particles of the present invention, showing no stress cracks.

The inventive method recognizes that the use of ferrous particles having a reduced hardness has several advantages. Among these advantages are the following. The reduced hardness, obtained as-cast without tempering, substantially avoids fracturing of the shot and risk of imbedded particles, thereby enhancing the rust resistance of the workpiece. FIG. 3B shows the ferrous particles of the present invention before use, wherein the particles show no signs of stress cracks. Further, without being bound to any theory, it is believed that the reduced hardness may provide an enhanced surface finish, such that, for example, a single blastcleaning operation performs the dual function of cleaning the workpiece and polishing the surface.

Figure 2:
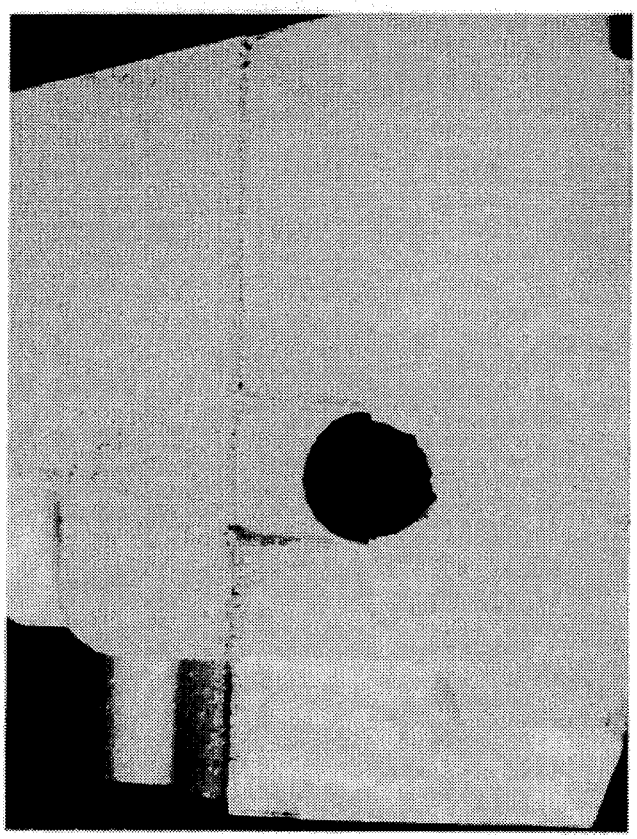
FIG. 2 is a close up at 1× power of a similar casting that has been blastcleaned in the same way with the ferrous particles of the present invention showing a bright surface finish.

Referring now to FIG. 2, there is shown an aluminum casting blastcleaned with the ferrous particles of the present invention. This casting has no ferrous particles imbedded therein, shows no signs of rust, and has a more polished surface than the casting cleaned with traditional martensite shot as shown in FIG. 1. Yet another advantageous aspect of the present invention is that the reduced hardness allows the use of less expensive, low grade steel wear parts in the blastcleaning, peening, profiling or other machinery used.

Figure 4B:
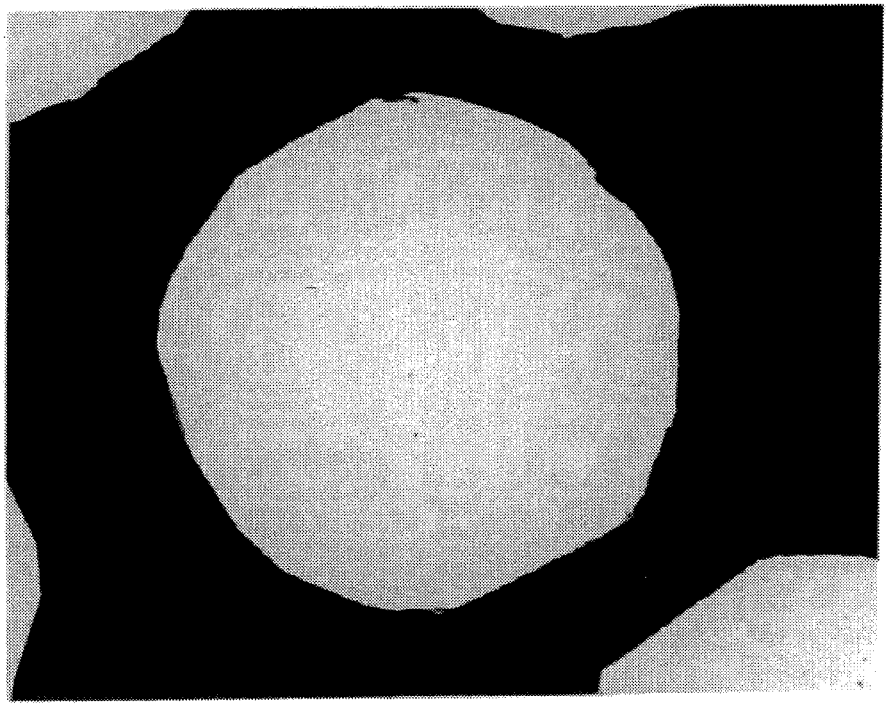
FIG. 4B is a close up at 100× power of used ferrous particles of the present invention, showing the material wearing in a more concentric layer fashion, rather than fracturing.
Figure 4A:
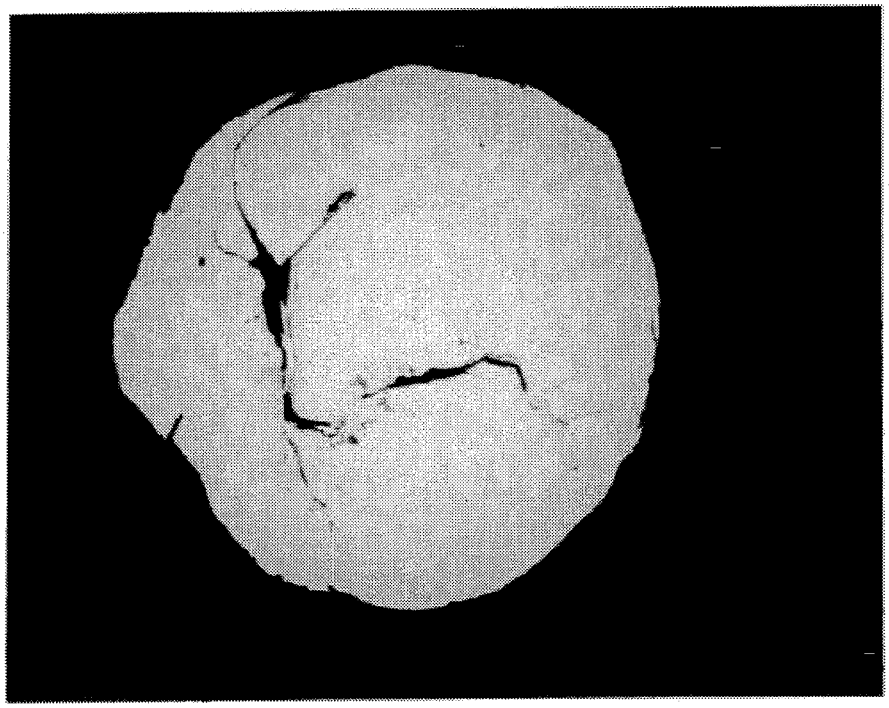
FIG. 4A is a close up at 100× power of used martensite shot showing smaller particles with extended stress cracks before fracturing during blastcleaning or peening.

Still another advantage of the present invention is that the reduced hardness further improves the wear characteristics and useful life of the ferrous particles themselves. The inventive ferrous particles, as shown in FIG. 4B, wear in a concentric, layer fashion as opposed to fracturing. On the contrary, an example of used Martensite shot showing extended stress cracks prone to fracturing during blast cleaning or peening is shown in FIG. 4A.

Figure 5:
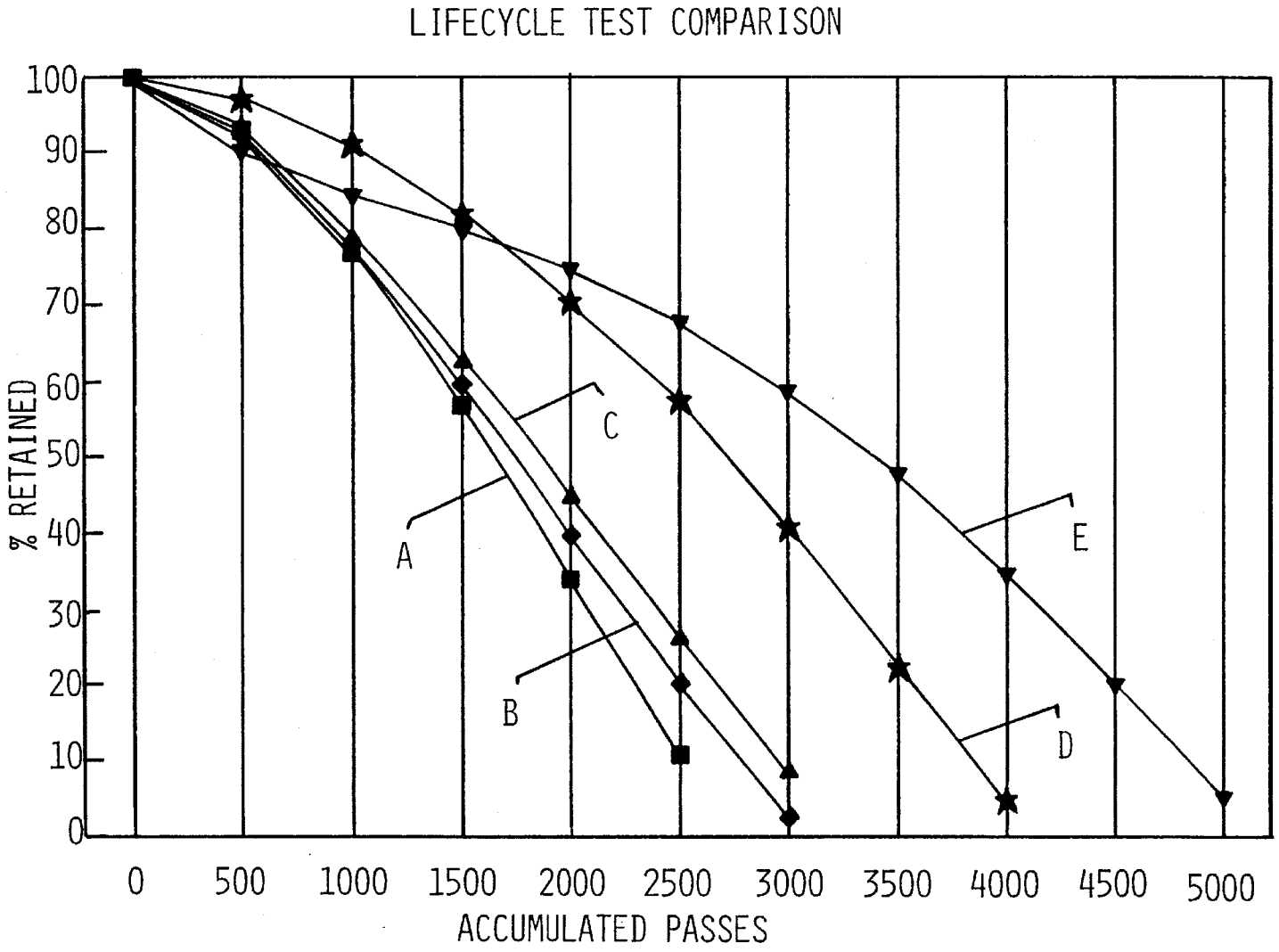
FIG. 5 is a life cycle test conducted in an ERVIN test machine on samples of martensite shot, stainless steel cut wire shot, and the ferrous particles of the present invention, demonstrating that the material of the present invention lasts from about 28% to about 51% longer than martensite shot, and approximately 20% less than cut wire stainless steel shot.

FIG. 5 is a life cycle test showing three different examples of Martensite, A, B, C. Each of the examples approach 0% retained between approximately 2,800 and approximately 3,300 accumulated passes. The ferrous particles D of the present invention do not approach 0% retained until approximately 4,200 accumulated passes. Stainless steel E has the longest life cycle, as shown on the graph at approximately 5,300 accumulated passes, but, as stated more fully above, is cost prohibitive in most cases. More particularly, each of the samples reached 0% retained at approximately the following numbers of accumulated passes: Martensite A: 2812; Martensite B: 3080 Martensite C: 3300; the ferrous particles D of the present invention: 4241; stainless steel E: 5285.

One of the preferred chemical compositions of the ferrous shot particles of the present invention is shown in Table 1.

TABLE 1

| (%) | C | Mn | Si | P | S | Al | Ni | Cr | Cu | Mo | Pb |
|---|---|---|---|---|---|---|---|---|---|---|---|
| Max: | .117 | .362 | .232 | .025 | .039 | .099 | .056 | .064 | .076 | .019 | .035 |
| Min: | .011 | .042 | .016 | .006 | .004 | .006 | .013 | .012 | .009 | .000 | .000 |
| σ | .021 | .058 | .036 | .003 | .006 | .011 | .005 | .006 | .005 | .003 | .003 |
| Avg: | .053 | .175 | .070 | .015 | .023 | .023 | .027 | .037 | .024 | .005 | .004 |

The numbers listed depict the percentage of the total composition. Of the sample, the maximum percentages are listed, as well as the minimum percentages. σ is the standard deviation of the sample. The averages are also listed for each element.

Table 2 gives the percentages only of the manganese, silicon and carbon of another sample of the ferrous shot particles of the preferred embodiment.

TABLE 2

| | Manganese (%) | Silicon (%) | Carbon (%) |
|---|---|---|---|
| Average: | .199 | .071 | .065 |
| σ | .0351 | .0260 | .0156 |
| Minimum: | .122 | .032 | .039 |
| Maximum: | .277 | .131 | .098 |

Table 3 specifies the microhardness in Rockwell C of ten samples of the inventive ferrous particles, each of these samples averaging 0.08% carbon, 0.10% manganese, and 0.02% silicon.

TABLE 3

| Microhardness (HRC) of ferrous particles having .08% C; .10% Mn; .02% Si |
|---|
| 20.8 |
| 37.8 |
| 39.0 |
| outside of scale range |
| 32.8 |
| 31.7 |
| 37.8 |
| 58.8 |
| 39.4 |
| 37.8 |
| Average:35.6 |

In the preferred embodiment, the ferrous particles have a hardness ranging between about 30 and about 40 Rockwell C. More preferably, these particles may range between about 34 and about 36 Rockwell C; and still more preferably the ferrous particles may have a hardness averaging about 35.6 Rockwell C.

In a second preferred embodiment, the ferrous particles have a hardness ranging between about 20 and about 30 Rockwell C; and more preferably between about 23 and about 27 Rockwell C.

It is to be understood that the ferrous particles of the present invention may have any suitable hardness and chemical composition which will be suitable for use on the particular workpiece chosen, and will still provide the desirable enhancement of rust resistance. Further, it would be desirable if such particles provide the optional but preferable enhancement of surface finish.

The ferrous particles of the preferred embodiment may have a carbon content falling within, but not limited to, any of the following ranges: between about 0.01% and about 0.05%; between about 0.05% and about 0.12%; between about 0.04% and about 0.10%; between about 0.04% and about 0.07%; between about 0.07% and about 0.10%; between about 0.01% and about 0.08%; between about 0.04% and about 0.08%; and between about 0.08% and about 0.10%. Further, the carbon content may average about 0.08%.

In a preferred embodiment of the present invention, the ferrous particles consist essentially of: greater than about 98% by weight iron; less than about 0.23% by weight silicon; less than about 0.12% by weight carbon; less than about 0.03% by weight phosphorus; less than about 0.04% by weight sulfur; less than about 0.36% by weight manganese; and less than about 0.04% by weight lead.

In another preferred embodiment of the present invention, the ferrous particles consists essentially of: between about 98.88% and about 99.88% by weight iron; between about 0.02% and about 0.23% by weight silicon; between about 0.01% and about 0.12% by weight carbon; between about 0.01% and about 0.03% by weight phosphorus; less than about 0.04% by weight sulfur; between about 0.04% and about 0.36% by weight manganese; and less than about 0.04% by weight lead.

Still more preferably, the ferrous particles consist essentially of: an average of about 99.54% by weight iron; an average of about 0.07% by weight silicon; an average of about 0.05% by weight carbon; an average of about 0.02% by weight phosphorus; an average of about 0.02% by weight sulfur; and an average of about 0.17% by weight manganese.

It is to be understood that the ferrous particles of the present invention may be formed by any suitable method. However, in the preferred embodiment, the method comprises the step of atomizing a molten metal into beads of a predetermined size distribution and shape, wherein, after screening, the beads are substantially ready for use. The molten metal is obtained by melting a supply of scrap 1008 or 1010 steel having a carbon content between about 0.08% and about 0.10% in an induction furnace for an amount of time sufficient to form the molten metal and slag the steel. The atomizing may be carried out by any conventionally known method such as a high velocity stream of water, spinning, high pressure air, or the like.

In order to achieve the ferrous particles having a hardness ranging between about 20 and about 30 Rockwell C, it may be necessary to melt a supply of steel having a carbon content between about 0.01% and about 0.07%.

The use of the scrap metal, which is quite inexpensive to obtain and is available in great quantity, provides the further advantage of allowing the production of the ferrous particles of the present invention in great quantity and at low cost.

To further illustrate the composition, the following examples are given. It is to be understood that these examples are provided for illustrative purposes and are not to be construed as limiting the scope of the present invention.

EXAMPLE 1

Aluminum exhaust manifolds having a hardness ranging between about 60 Brinell hardness and about 90 Brinell hardness were blastcleaned in a 12 ft. table blast WHEELABRATOR blast machine using a blend of conventional martensite round ball shot (S-460/S-550) and martensite grit (G-18/G-25). Another group of the same type of aluminum exhaust manifolds was blastcleaned using ferrous shot media obtained from the process described more fully above, the ferrous shot media consisting essentially of between about 98.88% and about 99.88% by weight Fe; between about 0.02% and about 0.23% by weight Si; between about 0.01% and about 0.12% by weight C; between about 0.01% and about 0.03% by weight P; less than about 0.04% by weight S; between about 0.04% and about 0.36% by weight Mn; and less than about 0.04% by weight Pb, the ferrous shot media having a hardness averaging between about 30 and about 40 Rockwell C, and a size distribution ranging between about S-170 and about S-230.

After blastcleaning, both the manifolds blastcleaned with conventional Martensite shot/grit, and the manifolds blastcleaned with the ferrous shot media as described above were misted or sprayed with a saltwater solution and put into plastic bags to attempt to accelerate the rusting process. The manifolds were marked and segregated overnight and inspected the next morning. The manifolds that were blasted with martensite shot/grit had rust on many areas of the parts and became increasingly discolored with rust over the following week. At the same time, the parts that were blasted with the ferrous shot media as described above had no rust in the morning and no rust after one week. Upon further inspection of these parts over the period of one month, no rust was detected.

In addition to testing for rust, the surface finish was evaluated. The parts blastcleaned with the ferrous shot media as described above were much brighter than those blastcleaned with martensite shot/grit and had a surface finish approaching that achievable with glass beads.

Similar tests were run on other types of aluminum exhaust manifolds with the same results.

EXAMPLE 2

Aluminum air intake manifolds having a hardness ranging between about 60 Brinell hardness and about 90 Brinell hardness were blastcleaned in a 12 ft. table blast WHEELABRATOR blast machine using a blend of conventional martensite round ball shot (S-460/S-550) and martensite grit (G-18/G-25). Another group of the same type of aluminum air intake manifolds was blastcleaned using a blend of S-170 and S-230 ferrous shot media as described in Example 1.

After blastcleaning, both the manifolds blastcleaned with conventional Martensite shot/grit, and the manifolds blastcleaned with the ferrous shot media as described in Example 1 were misted or sprayed with a saltwater solution and put into plastic bags to attempt to accelerate the rusting process. The manifolds were marked and segregated overnight and inspected the next morning. The manifolds that were blasted with martensite shot/grit had rust on many areas of the parts and became increasingly discolored with rust over the following week. At the same time, the parts that were blasted with the ferrous shot media as described in Example 1 had no rust in the morning and no rust after one week. Upon further inspection of these parts over the period of 3 to 4 weeks, no rust was detected.

In addition to testing for rust, the surface finish was evaluated. The parts blastcleaned with the ferrous shot media as described in Example 1 were much brighter than those blastcleaned with martensite shot/grit and had a surface finish approaching that achievable with glass beads.

EXAMPLE 3

Aluminum engine cylinder heads having a hardness ranging between about 60 Brinell hardness and about 90 Brinell hardness were blastcleaned in a 12 ft. table blast WHEELABRATOR blast machine using a blend of conventional martensite round ball shot (S-460/S-550) and martensite grit (G-18/G-25). Another group of the same type of aluminum engine cylinder heads was blastcleaned using a blend of S-170 and S-230 ferrous shot media as described in Example 1.

After blastcleaning, both the engine cylinder heads blastcleaned with conventional Martensite shot/grit, and the engine cylinder heads blastcleaned with the ferrous shot media as described in Example 1 were misted or sprayed with a saltwater solution and put into plastic bags to attempt to accelerate the rusting process. The engine cylinder heads were marked and segregated overnight and inspected the next morning. The engine cylinder heads that were blasted with martensite shot/grit had rust on many areas of the parts and became increasingly discolored with rust over the following week. At the same time, the parts that were blasted with the ferrous shot media as described in Example 1 had no rust in the morning and no rust after one week. Upon further inspection of these parts over the period of 3 to 4 weeks, no rust was detected.

In addition to testing for rust, the surface finish was evaluated. The parts blastcleaned with the ferrous shot media as described in Example 1 were much brighter than those blastcleaned with martensite shot/grit and had a surface finish approaching that achievable with glass beads.

EXAMPLE 4

Another group of aluminum exhaust manifolds, air intake manifolds, and engine cylinder heads having a hardness ranging between about 60 Brinell hardness and about 90 Brinell hardness were blastcleaned with both martensitic shot/grit and the ferrous shot media as described in Example 1. The parts were either put out in the rain, or soaked in water and then placed in an oven at 300°–400° F. to attempt to accelerate the rusting process. The parts were marked and segregated overnight and inspected the next morning. The parts that were blasted with martensite shot/grit had rust on many areas of the parts and became increasingly discolored with rust over the following week. At the same time, the parts that were blasted with the ferrous shot media as described in Example 1 had no rust in the morning and no rust after one week. Upon further inspection of these parts over the period of 3 to 4 weeks, no rust was detected.

In addition to testing for rust, the surface finish was evaluated. The parts blastcleaned with the ferrous shot media as described in Example 1 were much brighter than those blastcleaned with martensite shot/grit and had a surface finish approaching that achievable with glass beads.

EXAMPLE 5

Aluminum exhaust manifolds, air intake manifolds and engine cylinder heads are blastcleaned in a 12 ft. table blast WHEELABRATOR blast machine using a blend of conventional martensite round ball shot (S-460/S-550) and martensite grit (G-18/G-25). Another group of the same type of aluminum exhaust manifolds, air intake manifolds and engine cylinder heads is blastcleaned using ferrous shot media obtainable from the process described more fully above, the ferrous shot media having a Carbon content ranging between about 0.01% and about 0.07% by weight, the ferrous shot media having a hardness averaging between about 20 and about 30 Rockwell C, and a size distribution ranging between about S-170 and about S-230.

After blastcleaning, both the parts blastcleaned with conventional Martensite shot/grit, and the parts blastcleaned with the ferrous shot media as described above are misted or sprayed with a saltwater solution and put into plastic bags to attempt to accelerate the rusting process. The parts are marked and segregated overnight. Upon inspection after one day, the parts that are blasted with martensite shot/grit have rust on many areas of the parts and become increasingly discolored with rust after one week. At the same time, the parts that are blasted with the ferrous shot media as described above have no rust after one day and no rust after one week. Upon further inspection of these parts after one month, no rust is detected.

In addition to testing for rust, the surface finish is evaluated. The parts blastcleaned with the ferrous shot media as described above are much brighter than those blastcleaned with martensite shot/grit and have a surface finish approaching that achievable with glass beads.

EXAMPLE 6

Another group of aluminum exhaust manifolds, air intake manifolds, and engine cylinder heads are blastcleaned with both martensitic shot/grit and the ferrous shot media as described in Example 5. The parts are either put out in the rain, or are soaked in water and then are placed in an oven at 300°–400° F. to attempt to accelerate the rusting process. The parts are marked and segregated overnight and are inspected in one day. The parts that are blasted with martensite shot/grit have rust on many areas of the parts and become increasingly discolored with rust after one week. At the same time, the parts that are blasted with the ferrous shot media as described in Example 5 have no rust in one day and no rust after one week. Upon further inspection of these parts over a period of 3 to 4 weeks, no rust is detected.

In addition to testing for rust, the surface finish is evaluated. The parts blastcleaned with the ferrous shot media as described in Example 5 are much brighter than those blastcleaned with martensite shot/grit and have a surface finish approaching that achievable with glass beads.

EXAMPLE 7

Aluminum exhaust manifolds are blastcleaned in a 12 ft. table blast WHEELABRATOR blast machine using conventional martensite shot (S-170/S-230). Another group of the same type of aluminum exhaust manifolds is blastcleaned using ferrous shot media obtainable from the process described more fully above, the ferrous shot media consisting essentially of between about 98.88% and about 99.88% by weight Fe; between about 0.02% and about 0.23% by weight Si; between about 0.01% and about 0.12% by weight C; between about 0.01% and about 0.03% by weight P; less than about 0.04% by weight S; between about 0.04% and about 0.36% by weight Mn; and less than about 0.04% by weight Pb, the ferrous shot media having a hardness averaging between about 30 and about 40 Rockwell C, and a size distribution ranging between about S-170 and about S-230.

After blastcleaning, both the manifolds blastcleaned with conventional Martensite shot, and the manifolds blastcleaned with the ferrous shot media as described above are misted or are sprayed with a saltwater solution and put into plastic bags to attempt to accelerate the rusting process. The manifolds are marked and segregated overnight and are inspected in one day. The manifolds that are blasted with martensite shot have rust on many areas of the parts and become increasingly discolored with rust after one week. At the same time, the parts that are blasted with the ferrous shot media as described above have no rust after one day and no rust after one week. Upon further inspection of these parts over the period of one month, no rust is detected.

In addition to testing for rust, the surface finish is evaluated. The parts blastcleaned with the ferrous shot media as described above are much brighter than those blastcleaned with martensite shot and have a surface finish approaching that achievable with glass beads.

Similar tests are run on other types of aluminum exhaust manifolds with the same results.

EXAMPLE 8

Titanium alloy aircraft turbine blades having a hardness ranging between about 35 and about 42 Rockwell C are shot peened in an airless centrifugal wheel peening machine using conventional martensite shot (S-170/S-230). Another group of the same type of titanium alloy aircraft turbine blade is shot peened using ferrous shot media obtainable from the process described more fully above, the ferrous shot media having a hardness averaging between about 40 and about 50 Rockwell C, and a size distribution ranging between about S-170 and about S-230.

After peening, both the turbine blades peened with conventional Martensite shot, and the turbine blades peened with the ferrous shot media as described above are misted or are sprayed with a saltwater solution and put into plastic bags to attempt to accelerate the rusting process. The turbine blades are marked and segregated overnight and are inspected in one day. The turbine blades that are peened with martensite shot have rust on many areas of the parts and become increasingly discolored with rust after one week. At the same time, the parts that are peened with the ferrous shot media as described above have no rust after one day and no rust after one week. Upon further inspection of these parts over the period of one month, no rust is detected.

In addition to testing for rust, the surface finish is evaluated. The parts peened with the ferrous shot media as described above are much brighter than those peened with martensite shot and have a surface finish approaching that achievable with glass beads.

EXAMPLE 9

Aluminum alloy jet engine impellers having a hardness ranging between about 90 Brinell hardness and about 160 Brinell hardness are shot peened in an airless centrifugal wheel peening machine using conventional martensite shot (S-170/S-230). Another group of the same type of aluminum alloy jet engine impellers is shot peened using ferrous shot media obtainable from the process described more fully above, the ferrous shot media consisting essentially of between about 98.88% and about 99.88% by weight Fe; between about 0.02% and about 0.23% by weight Si; between about 0.01% and about 0.12% by weight C; between about 0.01% and about 0.03% by weight P; less than about 0.04% by weight S; between about 0.04% and about 0.36% by weight Mn; and less than about 0.04% by weight Pb, the ferrous shot media having a hardness averaging between about 30 and about 40 Rockwell C, and a size distribution ranging between about S-170 and about S-230.

After peening, both the jet engine impellers peened with conventional Martensite shot, and the jet engine impellers peened with the ferrous shot media as described above are misted or are sprayed with a saltwater solution and put into plastic bags to attempt to accelerate the rusting process. The jet engine impellers are marked and segregated overnight and are inspected in one day. The jet engine impellers that are peened with martensite shot have rust on many areas of the parts and become increasingly discolored with rust after one week. At the same time, the parts that are peened with the ferrous shot media as described above have no rust after one day and no rust after one week. Upon further inspection of these parts over the period of one month, no rust is detected.

In addition to testing for rust, the surface finish is evaluated. The parts peened with the ferrous shot media as described above are much brighter than those peened with martensite shot and have a surface finish approaching that achievable with glass beads.

EXAMPLE 10

Nickel-cobalt alloy gas turbine parts having a hardness averaging about 200 Brinell hardness are shot peened in an airless centrifugal wheel peening machine using conventional martensite shot (S-170/S-230). Another group of the same type of nickel-cobalt alloy gas turbine parts is shot peened using a blend of S-170 and S-230 ferrous shot media as described in Example 9.

After peening, both the gas turbine parts peened with conventional Martensite shot, and the gas turbine parts peened with the ferrous shot media as described above are misted or are sprayed with a saltwater solution and put into plastic bags to attempt to accelerate the rusting process. The gas turbine parts are marked and segregated overnight and are inspected in one day. The gas turbine parts that are peened with martensite shot have rust on many areas of the parts and become increasingly discolored with rust after one week. At the same time, the parts that are peened with the ferrous shot media as described above have no rust after one day and no rust after one week. Upon further inspection of these parts over the period of one month, no rust is detected.

In addition to testing for rust, the surface finish is evaluated. The parts peened with the ferrous shot media as described above are much brighter than those peened with martensite shot and have a surface finish approaching that achievable with glass beads.

EXAMPLE 11

Nickel-cobalt alloy jet engine pump shafts having a hardness averaging about 200 Brinell hardness are shot peened in an airless centrifugal wheel peening machine using conventional martensite shot (S-170/S-230). Another group of the same type of nickel-cobalt alloy jet engine pump shafts is shot peened using a blend of S-170 and S-230 ferrous shot media as described in Example 9.

After peening, both the pump shafts peened with conventional Martensite shot, and the pump shafts peened with the ferrous shot media as described above are misted or are sprayed with a saltwater solution and put into plastic bags to attempt to accelerate the rusting process. The pump shafts are marked and segregated overnight and are inspected in one day. The pump shafts that are peened with martensite shot have rust on many areas of the parts and become increasingly discolored with rust after one week. At the same time, the parts that are peened with the ferrous shot media as described above have no rust after one day and no rust after one week. Upon further inspection of these parts over the period of one month, no rust is detected.

In addition to testing for rust, the surface finish is evaluated. The parts peened with the ferrous shot media as described above are much brighter than those peened with martensite shot and have a surface finish approaching that achievable with glass beads.

EXAMPLE 12

Brass valves and water meters are blastcleaned in a 12 ft. table blast WHEELABRATOR blast machine using conventional martensite shot (S-170/S-230) o Another group of the same type of brass valves and water meters is blastcleaned using a blend of S-170 and S-230 ferrous shot media as described in Example 7.

After blastcleaning, both the valves and water meters blastcleaned with conventional Martensite shot, and the valves and water meters blastcleaned with the ferrous shot media as described above are misted or are sprayed with a saltwater solution and put into plastic bags to attempt to accelerate the rusting process. The valves and water meters are marked and segregated overnight and are inspected in one day. The valves and water meters that are blasted with martensite shot have rust on many areas of the parts and become increasingly discolored with rust after one week. At the same time, the parts that are blasted with the ferrous shot media as described above have no rust after one day and no rust after one week. Upon further inspection of these parts over the period of one month, no rust is detected.

In addition to testing for rust, the surface finish is evaluated. The parts blastcleaned with the ferrous shot media as described above are much brighter than those blastcleaned with martensite shot and have a surface finish approaching that achievable with glass beads.

While preferred embodiments, forms and arrangements of parts of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A method for enhancing the rust resistance and the surface finish of a non-ferrous metallic workpiece having a surface, the method comprising the step of:

impinging the workpiece surface for a predetermined amount of time with a high velocity stream of ferrous particles, the ferrous particles having a hardness less than approximately 40 Rockwell C, and at least a majority of the ferrous particles having a generally spherical, bead shape having substantially no protuberances on the outer surfaces thereof, which shape wears during the impinging in a substantially concentric manner.

2. The method as defined in claim 1 wherein the ferrous particles have a hardness between about 30 and about 40 Rockwell C.

3. The method as defined in claim 1 wherein the ferrous particles have a hardness between about 34 and about 36 Rockwell C.

4. The method as defined in claim 1 wherein the ferrous particles have a hardness averaging about 35.6 Rockwell C.

5. The method as defined in claim 1 wherein the ferrous particles have a hardness between about 20 and about 30 Rockwell C.

6. The method as defined in claim 1 wherein the ferrous particles have a hardness between about 23 and about 27 Rockwell C.

7. The method as defined in claim 1 wherein the ferrous particles have a carbon content between about 0.01% and about 0.05%.

8. The method as defined in claim 1 wherein the ferrous particles have a carbon content between about 0.05% and about 0.12%.

9. The method as defined in claim 1 wherein the ferrous particles have a carbon content between about 0.04% and about 0.10%.

10. The method as defined in claim 1 wherein the ferrous particles have a carbon content between about 0.04% and about 0.07%.

11. The method as defined in claim 1 wherein the ferrous particles have a carbon content between about 0.07% and about 0.10%.

12. The method as defined in claim 1 wherein the ferrous particles have a carbon content between about 0.01% and about 0.08%.

13. The method as defined in claim 1 wherein the ferrous particles have a carbon content between about 0.04% and about 0.08%.

14. The method as defined in claim 1 wherein the ferrous particles have a carbon content between about 0.08% and about 0.10%.

15. The method as defined in claim 1 wherein the ferrous particles have a carbon content averaging about 0.08%.

16. The method as defined in claim 1 wherein the ferrous particles consist essentially of: greater than about 98% by weight Fe; less than about 0.23% by weight Si; less than about 0.12% by weight C; less than about 0.03% by weight P; less than about 0.04% by weight S; less than about 0.36% by weight Mn; and less than about 0.04% by weight Pb.

17. The method as defined in claim 1 wherein the ferrous particles consist essentially of: between about 98.88% and about 99.88% by weight Fe; between about 0.02% and about 0.23% by weight Si; between about 0.01% and about 0.12% by weight C; between about 0.01% and about 0.03% by weight P; less than about 0.04% by weight S; between about 0.04% and about 0.36% by weight Mn; and less than about 0.04% by weight Pb.

18. The method as defined in claim 17 wherein the ferrous particles consist essentially of: an average of about 99.54% by weight Fe; an average of about 0.07% by weight Si; an average of about 0.05% by weight C; an average of about 0.02% by weight P; an average of about 0.02% by weight S; and an average of about 0.17% by weight Mn.

19. The method as defined in claim 1 wherein the impinging step is carried out during at least one of a blastcleaning, profiling, peening, and surface preparation process.

20. The method as defined in claim 1 wherein the workpiece is formed from aluminum.

21. The method as defined in claim 2 wherein the ferrous particles are formed by a method comprising the step of:

atomizing a molten metal into beads of a predetermined size distribution and shape, wherein, after screening, the beads are substantially ready for use, the molten metal obtained by melting a supply of steel having a carbon content between about 0.08% and about 0.10% in an induction furnace for an amount of time sufficient to form the molten metal and slag the steel.

22. The method as defined in claim 5 wherein the ferrous particles are formed by a method comprising the step of:

atomizing a molten metal into beads of a predetermined size distribution and shape, wherein, after screening, the beads are substantially ready for use, the molten metal obtained by melting a supply of steel having a carbon content between about 0.01% and about 0.07% in an induction furnace for an amount of time sufficient to form the molten metal and slag the steel.

23. A method for enhancing the rust resistance and the surface finish of a non-ferrous metallic workpiece having a surface, the method comprising the step of:

impinging the workpiece surface for a predetermined amount of time with a high velocity stream of ferrous particles, wherein the impinging step is carried out during at least one of a blastcleaning, profiling, peening, and surface preparation process, the ferrous particles having a hardness between about 30 and about 40 Rockwell C, and at least a majority of the ferrous particles having a generally spherical, bead shape having substantially no protuberances on the outer surfaces thereof, which shape wears during the impinging in a substantially concentric manner, wherein the ferrous particles consist essentially of: greater than about 98% by weight Fe; less than about 0.23% by weight Si; less than about 0.12% by weight C; less than about 0.03% by weight P; less than about 0.04% by weight S; less than about 0.36% by weight Mn; and less than about 0.04% by weight Pb, and wherein the ferrous particles are formed by a method comprising the step of:

atomizing a molten metal into beads of a predetermined size distribution and shape, wherein, after screening, the beads are substantially ready for use, the molten metal obtained by melting a supply of steel having a carbon content between about 0.08% and about 0.10% in an induction furnace for an amount of time sufficient to form the molten metal and slag the steel.

24. The method as defined in claim 23 wherein the workpiece is formed from aluminum.

25. The method as defined in claim 23 wherein the ferrous particles have a hardness between about 34 and about 36 Rockwell C.

26. A method for enhancing the rust resistance and the surface finish of an aluminum workpiece having a surface, the method comprising the step of:

blastcleaning the workpiece surface for a predetermined amount of time with a high velocity stream of ferrous particles, the ferrous particles having a hardness less than approximately 40 Rockwell C, and at least a majority of the ferrous particles having a generally spherical, bead shape having substantially no protuberances on the outer surfaces thereof, which shape wears during the impinging in a substantially concentric manner.

27. The method as defined in claim 26 wherein the ferrous particles have a hardness between about 30 and about 40 Rockwell C.

28. The method as defined in claim 27 wherein the ferrous particles consist essentially of: greater than about 98% by weight Fe; less than about 0.23% by weight Si; less than about 0.12% by weight C; less than about 0.03% by weight P; less than about 0.04% by weight S; less than about 0.36% by weight Mn; and less than about 0.04% by weight Pb.

29. The method as defined in claim 27 wherein the ferrous particles consist essentially of: between about 98.88% and about 99.88% by weight Fe; between about 0.02% and about 0.23% by weight Si; between about 0.01% and about 0.12% by weight C; between about 0.01% and about 0.03% by weight P; less than about 0.04% by weight S; between about 0.04% and about 0.36% by weight Mn; and less than about 0.04% by weight Pb.

30. The method as defined in claim 29 wherein the ferrous particles consist essentially of: an average of about 99.54% by weight Fe; an average of about 0.07% by weight Si; an average of about 0.05% by weight C; an average of about 0.02% by weight P; an average of about 0.02% by weight S; and an average of about 0.17% by weight Mn.

31. The method as defined in claim 28 wherein the ferrous particles are formed by a method comprising the step of:

atomizing a molten metal into beads of a predetermined size distribution and shape, wherein, after screening, the beads are substantially ready for use, the molten metal obtained by melting a supply of steel having a carbon content between about 0.08% and about 0.10% in an induction furnace for an amount of time sufficient to form the molten metal and slag the steel.

32. A method for enhancing the rust resistance and the surface finish of an aluminum workpiece having a surface, the method comprising the step of:

blastcleaning the workpiece surface for a predetermined amount of time with a high velocity stream of ferrous particles, the ferrous particles having a hardness between about 30 and about 40 Rockwell C, and at least a majority of the ferrous particles having a generally spherical, bead shape having substantially no protuberances on the outer surfaces thereof, which shape wears during the impinging in a substantially concentric manner, wherein the ferrous particles consist essentially of: between about 98.88% and about 99.88% by weight Fe; between about 0.02% and about 0.23% by weight Si; between about 0.01% and about 0.12% by weight C; between about 0.01% and about 0.03% by weight P; less than about 0.04% by weight S; between about 0.04% and about 0.36% by weight Mn; and less than about 0.04% by weight Pb, and wherein the ferrous particles are formed by a method comprising the step of:

atomizing a molten metal into beads of a predetermined size distribution and shape, wherein, after screening, the beads are substantially ready for use, the molten metal obtained by melting a supply of steel having a carbon content between about 0.08% and about 0.10% in an induction furnace for an amount of time sufficient to form the molten metal and slag the steel.

33. The method as defined in claim 1 wherein, after 2500 accumulated passes on an Ervin Test Machine, the ferrous particles approach between about 50% and about 60% retained.

34. The method as defined in claim 23 wherein, after 2500 accumulated passes on an Ervin Test Machine, the ferrous particles approach between about 50% and about 60% retained.

35. The method as defined in claim 26 wherein, after 2500 accumulated passes on an Ervin Test Machine, the ferrous particles approach between about 50% and about 60% retained.

36. The method as defined in claim 32 wherein, after 2500 accumulated passes on an Ervin Test Machine, the ferrous particles approach between about 50% and about 60% retained.

* * * * *